US010450038B2

(12) United States Patent
Vandenworm

(10) Patent No.: US 10,450,038 B2
(45) Date of Patent: Oct. 22, 2019

(54) CONTINUOUS VERTICAL TUBULAR HANDLING AND HOISTING BUOYANT STRUCTURE

(71) Applicant: Jurong Shipyard PTE LTD., Singapore (SG)

(72) Inventor: Nicolaas Johannes Vandenworm, Houston, TX (US)

(73) Assignee: Jurong Shipyard Pte Ltd, Singapore (SG)

( * ) Notice: Subject to any disclaimer, the term of this patent is extended or adjusted under 35 U.S.C. 154(b) by 13 days.

(21) Appl. No.: 15/634,718

(22) Filed: Jun. 27, 2017

(65) Prior Publication Data

US 2019/0016418 A1 Jan. 17, 2019

(51) Int. Cl.

| | |
|---|---|
| ***B63B 21/50*** | (2006.01) |
| ***B63B 1/04*** | (2006.01) |
| ***B63B 27/14*** | (2006.01) |
| ***B63B 35/44*** | (2006.01) |
| ***B63B 39/02*** | (2006.01) |
| ***B63B 39/00*** | (2006.01) |
| *E21B 19/20* | (2006.01) |
| *E21B 19/14* | (2006.01) |
| *B63B 35/50* | (2006.01) |
| *B63B 21/00* | (2006.01) |

(52) U.S. Cl.

CPC ..... *B63B 21/50* (2013.01); *B63B 1/041* (2013.01); *B63B 27/14* (2013.01); *B63B 35/44* (2013.01); *B63B 39/005* (2013.01); *B63B 39/02* (2013.01); *B63B 35/50* (2013.01); *B63B 2021/003* (2013.01); *B63B 2035/4473* (2013.01); *E21B 19/143* (2013.01); *E21B 19/20* (2013.01)

(58) Field of Classification Search

CPC ..... B63B 35/4413; B63B 2035/448; B63B 27/00; B63B 27/02; B63B 27/04; B63B 27/10; B63B 27/12; E21B 19/143; E21B 19/20

See application file for complete search history.

(56) References Cited

U.S. PATENT DOCUMENTS

| | | | |
|---|---|---|---|
| 2,156,635 | A | 5/1939 | Mascuch et al. |
| 3,041,639 | A | 7/1962 | Atlas |

(Continued)

FOREIGN PATENT DOCUMENTS

| | | | |
|---|---|---|---|
| WO | WO-2015088745 | A1 | 6/2015 |
| WO | WO-2016137643 | A1 | 9/2016 |

*Primary Examiner* — Andrew Polay

(74) *Attorney, Agent, or Firm* — Cesari and McKenna, LLP

(57) ABSTRACT

A continuous vertical tubular handling and hoisting buoyant structure has a hull, a main deck, an upper neck extending downwardly from the main deck, an upper frustoconical side section, an intermediate neck, a lower neck that extends from the intermediate neck, an ellipsoidal keel and a fin-shaped appendage secured to a lower and an outer portion of the exterior of the ellipsoid keel. The upper frustoconical side section is located below the upper neck and maintained to be above a water line for a transport depth and partially below the water line for an operational depth of the buoyant structure. An automated stand building system mounted to the hull is in communication with a controller and configured to make up the marine risers, make up casing, and make up drill pipe.

15 Claims, 12 Drawing Sheets

(56) References Cited

U.S. PATENT DOCUMENTS

| | | | | |
|---|---|---|---|---|
| 3,831,385 | A | 8/1974 | Hudson et al. | |
| 4,117,691 | A | 10/1978 | Spray | |
| 4,281,615 | A | 8/1981 | Wilson et al. | |
| 4,282,822 | A | 8/1981 | Jackson | |
| 4,446,808 | A | 5/1984 | Colin | |
| 4,549,835 | A | 10/1985 | Ando et al. | |
| 4,640,214 | A | 2/1987 | Bruns | |
| 4,679,517 | A | 7/1987 | Kramer | |
| 4,850,439 | A * | 7/1989 | Lund | E21B 19/20 175/52 |
| 4,984,935 | A | 1/1991 | de Oliveira Filho et al. | |
| 5,573,353 | A | 11/1996 | Recalde | |
| 6,766,860 | B2 * | 7/2004 | Archibald | E21B 19/004 166/341 |
| 7,958,835 | B2 | 6/2011 | Srinivasan | |
| 8,251,003 | B2 * | 8/2012 | Vandenworm | B63B 1/041 114/230.2 |
| 8,662,000 | B2 | 3/2014 | Vandenworm | |
| 2009/0126616 | A1 | 5/2009 | Srinivasan | |
| 2013/0084136 | A1 | 4/2013 | Losnedal et al. | |
| 2013/0133563 | A1 | 5/2013 | Kroecker | |
| 2015/0016925 | A1 * | 1/2015 | Larkin | E21B 19/14 414/22.63 |
| 2016/0160587 | A1 * | 6/2016 | Misson | E21B 19/143 414/22.62 |

* cited by examiner

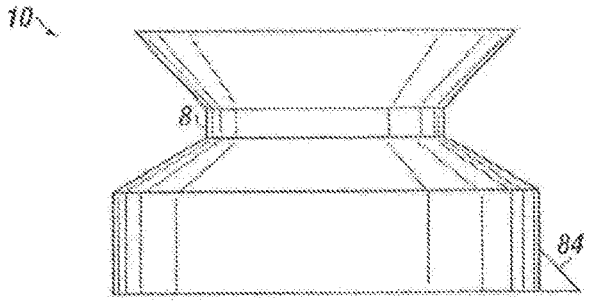
FIGURE 12
FIGURE 13
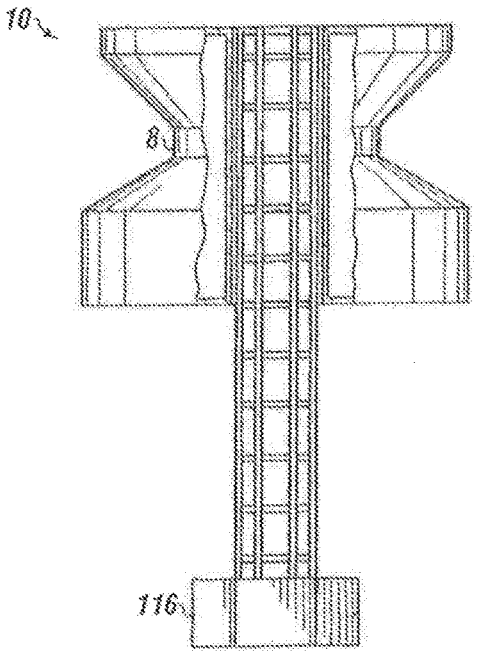
FIGURE 14
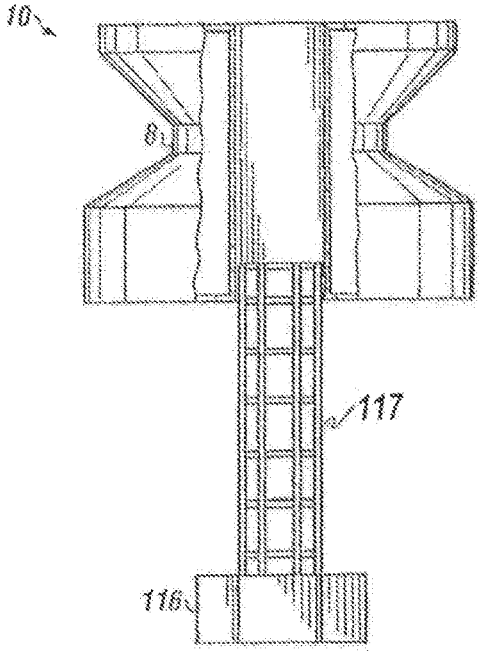

CONTINUOUS VERTICAL TUBULAR HANDLING AND HOISTING BUOYANT STRUCTURE

CROSS REFERENCE TO RELATED APPLICATIONS

The present application claims priority to and the benefit of PCT Application Serial No. PCT/US2015/057397 filed on Oct. 26, 2015, entitled "BUOYANT STRUCTURE," which claims the benefit of U.S. patent application Ser. No. 14/524,992 filed on Oct. 27, 2014, entitled "BUOYANT STRUCTURE" now abandoned, which is a Continuation in Part of issued U.S. patent application Ser. No. 14/105,321 filed on Dec. 13, 2013, entitled "BUOYANT STRUCTURE," issued as U.S. Pat. No. 8,869,727 on Oct. 28, 2014, which is a Continuation in Part of issued U.S. patent application Ser. No. 13/369,600 filed on Feb. 9, 2012, entitled "STABLE OFFSHORE FLOATING DEPOT," issued as U.S. Pat. No. 8,662,000 on Mar. 4, 2014, which is a Continuation in Part of issued U.S. patent application Ser. No. 12/914,709 filed on Oct. 28, 2010, issued as U.S. Pat. No. 8,251,003 on Aug. 28, 2012, which claims the benefit of U.S. Provisional Patent Application Ser. No. 61/259,201 filed on Nov. 8, 2009 and U.S. Provisional Patent Application Ser. No. 61/262,533 filed on Nov. 18, 2009; and claims the benefit of U.S. Provisional Patent Application Ser. No. 61/521,701 filed on Aug. 9, 2011, both expired. These references are hereby incorporated in their entirety.

FIELD

The present embodiments generally relate to a continuous vertical tubular handling and hoisting buoyant structure for supporting offshore oil and gas operations.

BACKGROUND

A need exists for a continuous vertical tubular handling and hoisting buoyant structure.

A further need exists for a continuous vertical tubular handling and hoisting buoyant structure that provides wave damping.

The present embodiments meet these needs.

BRIEF DESCRIPTION OF THE DRAWINGS

The detailed description will be better understood in conjunction with the accompanying drawings as follows:

FIG. 12 is detailed view of the continuous vertical tubular handling and hoisting buoyant structure with an intermediate neck.

FIG. 13 is a cut away view of the continuous vertical tubular handling and hoisting buoyant structure with an intermediate n in a transport configuration.

FIG. 14 is a cut away view of the continuous vertical tubular handling and hoisting buoyant structure with an intermediate neck in an operational configuration.

Figure 1:
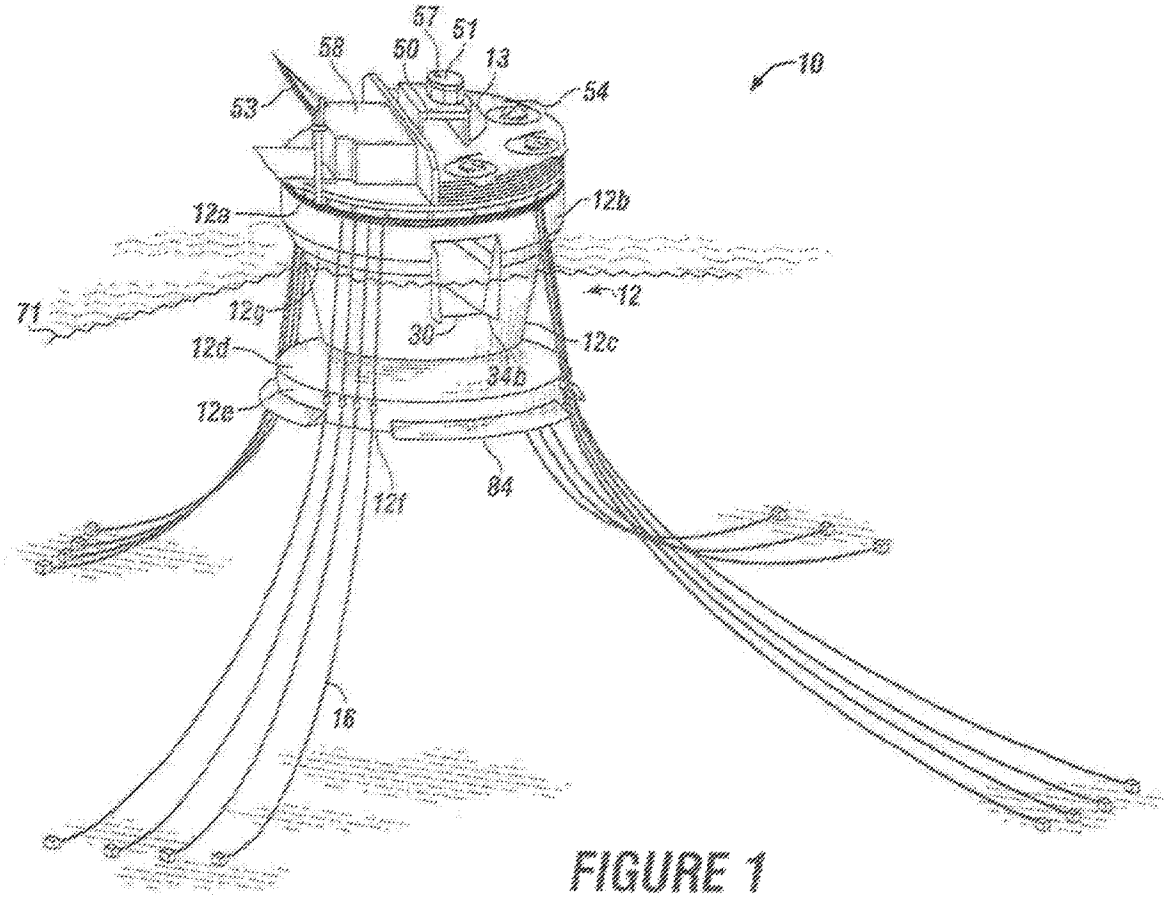
FIG. 1 is a perspective view of a continuous vertical tubular handling and hoisting buoyant structure.

The present embodiments are detailed below with reference to the listed Figures.

DETAILED DESCRIPTION OF THE EMBODIMENTS

Before explaining the present apparatus in detail it is to be understood that the apparatus is not limited to the particular embodiments and that it can be practiced or carried out in various ways.

The present embodiments relate to a continuous vertical tubular handling and hoisting buoyant structure for supporting offshore oil and gas operations.

The embodiments prevent injuries to personnel from equipment by providing in hull marine riser stands, in hull casing stands, and in hull drill pipe stands for already made-up marine risers, casings and drill pipe to reduce on deck make up time while in heavy-seas.

The embodiments protect the hands on deck from heavy seas by providing increased stability.

The embodiments enable the offshore structure to be towed to an offshore disaster and operate as a command center to facilitate in the control of a disaster, and can act as a hospital, or triage center.

The following terms are used herein:

The term "docking system" refers to a device that allows fastening of drilling equipment to a spire, such as a fingerboard.

The term "equipment moving robots" refers to automated trackable devices that are able to pick up and deliver equipment from one location to another on the buoyant structure. The trackable devices can move along rails, or beams from one storage location to a final destination. The robots have processors and computer readable media that stores zone locations of equipment on the buoyant structure. Equipment moving robots can contain RFID readers, which connect to processors to provide accurate location to within inches of the equipment, such as 2 inches.

The term "marine objects" as used herein includes marine tubulars, and marine chemical, and marine equipment.

The term "material recognition system" refers to a camera and database, which perform a material recognition, akin to a facial recognition system. For example, the material recognition system can scan a 3 dimensional pipe and match the pipe to preexisting image of similar pipe or match to data points identifying the image as a pipe.

The term "priority zone" as used herein refers to a map of a drill rig floor, or main deck and locations on or between the main deck and ellipsoid keel, which are coded, based on hazardous components of equipment or materials and have a specific geographic location on the buoyant structure. For example, one zone might be an "A" priority zone, because the "A" zone only contains materials that have volatile organic components, and a "Z" priority zone only contains pipe that that are not explosive.

The term "torque machine" as used herein refers to an iron roughneck, such as a torque wrench.

The term "RFID database" refers to a database in the computer readable media that includes part name, manufacturer, date of manufacture, serial number, priority zone, and date of install by part name, repair history by part name, and installation and connection sequences for safe and continuous use. For example, the RFID database can contain data such as a butterfly valve, made by AAA Valve Company, manufactured on Mar. 12, 2017 with Ser. No. 234,432, having a C priority zone with an install date of May 11, 2017 for engaging 300 psi mud flow conduits.

The invention relates to a continuous vertical tubular handling and hoisting buoyant structure with an axis for making up, breaking out and installing marine objects.

The continuous vertical tubular handling and hoisting buoyant structure has a hull with a main deck.

The hull has an upper neck connected to the main deck.

The hull has an upper frustoconical side section connected to the upper neck and an intermediate neck connected to the upper frustoconical side section.

The hull has a lower frustoconical side section that extends from intermediate neck.

An ellipsoid keel is used with a horizontal plane that is mounted to the lower frustoconical side section.

A fin-shaped appendage is secured to an outer portion of the ellipsoid keel, and a moon pool formed in the hull.

A spire is mounted to the hull with a crossbeam.

The hull has a drill floor mounted above the main deck and the ellipsoid keel and around the moon pool.

In the hull, between the main deck and the ellipsoid keel is formed a marine riser stand having an riser opening in the main deck and extending toward the ellipsoid keel in parallel with the axis for containing a made-up marine riser.

In the hull, between the main deck and the ellipsoid keel is formed a casing stand having a casing opening in the main deck and extending toward the ellipsoid keel in parallel with the axis for containing a made-up casing.

In the hull, between the main deck and the ellipsoid keel is formed a drill pipe stand having a drill pipe opening in the main deck and extending toward the ellipsoid keel in parallel with the axis for containing made-up drill pipe.

Each stand is oriented at an angle from 60 degrees to 120 degrees to the horizontal plane of the ellipsoid keel.

Each made-up marine riser, made-up casing, or made-up drill pipe has a length from 50 feet to 270 feet.

The continuous vertical tubular handling and hoisting buoyant structure has a controller with a processor and non-evanescent non-transitory computer readable media.

The computer readable media contains a vessel management system with priority zones for marine objects within the hull.

The continuous vertical tubular handling and hoisting buoyant structure has a vertically adjustable beam intersecting hoist mounted to the crossbeam proximate the moon pool and in communication with the controller comprising at least one dynamic intersecting support member configured for engaging bottom hole assemblies.

The continuous vertical tubular handling and hoisting buoyant structure has an automated racking system mounted to the hull in communication with the controller.

The automated racking system is configured to install made-up marine risers into the marine riser stand made up casing into the casing stand, or made up drill pipe into the drill pipe stand.

The continuous vertical tubular handling and hoisting buoyant structure has an automated stand building system mounted to the hull in communication with the controller and adjacent the automated racking system.

The automated stand building system is configured to make up marine risers, make up casing and make-up drill pipe from an angle from 55 to 125 degrees from the horizontal plane of the ellipsoid keel.

Turning now to the Figures, FIG. 1 depicts a continuous vertical tubular handling and hoisting buoyant structure for operationally supporting offshore exploration, drilling, production, and storage installations according to an embodiment of the invention.

The continuous vertical tubular handling and hoisting buoyant structure 10 can include a hull 12, which can carry a superstructure 13 thereon. The superstructure 13 can include a diverse collection of equipment and structures, such as living quarters and crew accommodations 58, equipment storage, a heliport 54, and a myriad of other structures, systems, and equipment, depending on the type of offshore operations to be supported. Cranes 53 can be mounted to the superstructure. The hull 12 can be moored to the seafloor by a number of catenary mooring lines 16. The superstructure can include an aircraft hangar 50. A control tower 51 can be built on the superstructure. The control tower can have a dynamic position system 57.

The continuous vertical tubular handling and hoisting buoyant structure can have a unique hull shape.

Figure 2:
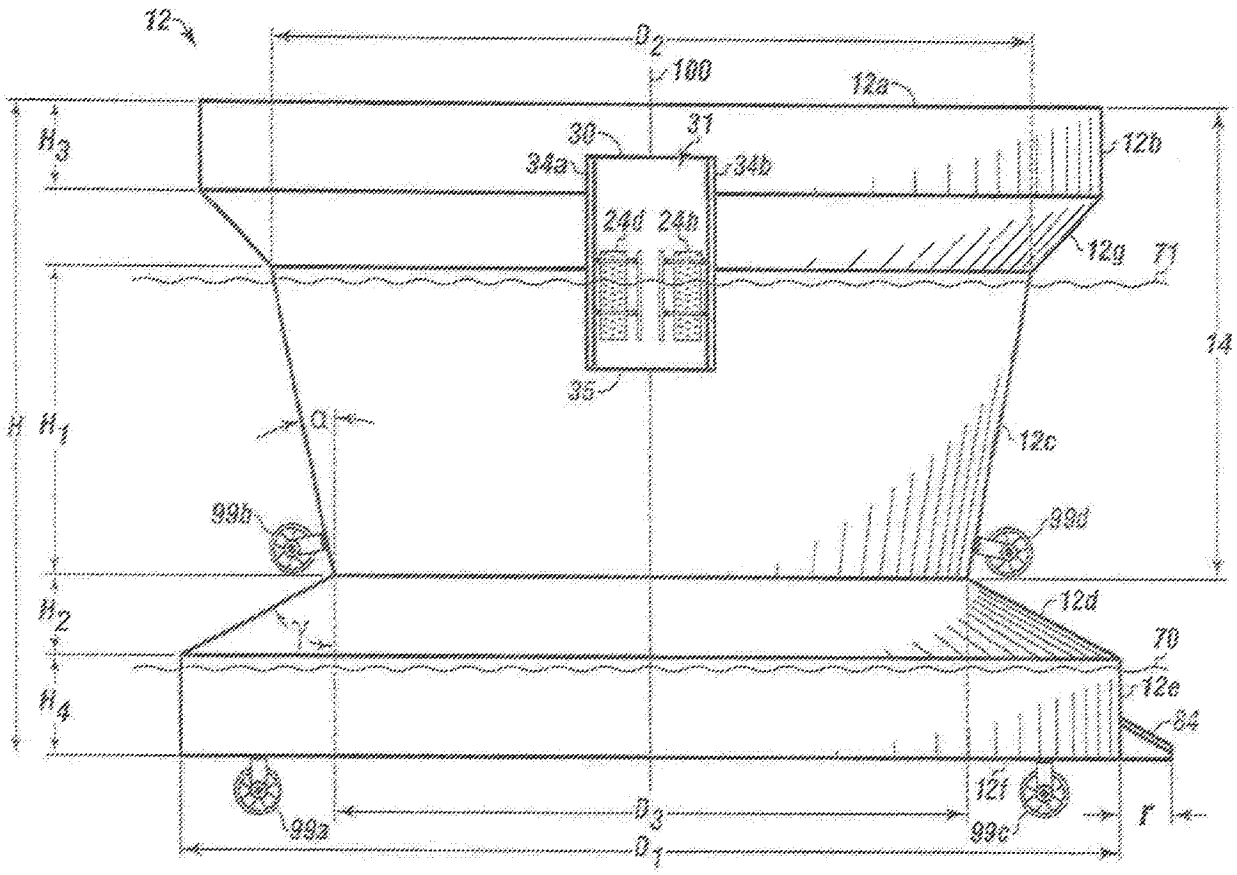
FIG. 2 is a vertical profile drawing of the hull of the continuous vertical tabular handling and hoisting buoyant structure.

Referring to FIGS. 1 and 2, the hull 12 of the continuous vertical tubular handling and hoisting buoyant structure 10 can have a main deck 12*a*, which can be circular; and a height H. Extending downwardly from the main deck 12*a* can be an upper frustoconical portion 14.

In embodiments, the upper frustoconical portion 14 can have an upper neck 12*b* extending downwardly from the main deck 12*a*, an inwardly-tapering upper frustoconical side section 12*g* located below the upper neck 12*b* and connecting to an intermediate inwardly-tapering frustoconical side section 12*c*.

The continuous vertical tubular handling and hoisting buoyant structure 10 also can have a lower frustoconical side section 12*d* extending downwardly from the intermediate inwardly-tapering frustoconical side section 12*c* and flares outwardly. Both the lower inwardly-tapering frustoconical side section 12*c* and the lower frustoconical side section 12*d* can be below the operational depth 71.

A lower neck 12*e* extending from the lower frustoconical side section 12*d* toward the ellipsoid keel 12*f*.

The intermediate inwardly-tapering frustoconical side section 12*c* can have a substantially greater vertical height H1 than lower frustoconical side section 12*d* shown as H2. Upper neck 12*b* can have a slightly greater vertical height H3 than a lower neck 12*e* extending from the lower frustoconical side section 12*d* shown as H4.

As shown, the upper neck 12*b* can connect to inwardly-tapering upper frustoconical side section 12*g* so as to provide for a main deck of greater radius than the hull radius along with the superstructure 13, which can be round, square or another shape, such as a half moon. Inwardly-tapering upper frustoconical side section 12*g* can be located above the operational depth 71.

Fin-shaped appendages 84 can be attached to a lower and an outer portion of the exterior of the hull.

The hull 12 is depicted with a plurality of catenary mooring lines 16 for mooring the buoyant structure to create a mooring spread.

FIG. 2 is a simplified view of a vertical profile of the hull according to an embodiment.

Two different depths are shown, the operational depth 71 and the transit depth 70.

The main deck 12*a*, upper neck 12*b*, inwardly-tapering upper frustoconical side section 12*g*, intermediate inwardly-tapering frustoconical side section 12*c*, lower frustoconical side section 12*d*, lower neck 12*e*, and matching ellipsoidal keel 12*f* are all co-axial with a common vertical axis 100. In embodiments, the hull 12 can be characterized by an ellipsoidal cross section when taken perpendicular to the vertical axis 100 at any elevation.

Due to its ellipsoidal planform, the dynamic response of the hull 12 is independent of wave direction (when neglecting any asymmetries in the mooring system, risers, and underwater appendages), thereby minimizing wave-induced yaw forces. Additionally, the conical form of the hull 12 is structurally efficient, offering a high payload and storage volume per ton of steel when compared to traditional ship-shaped offshore structures. The hull 12 can have ellipsoidal walls which are ellipsoidal in radial cross-section, but such shape may be approximated using a large number of flat metal plates rather than bending plates into a desired curvature. Although an ellipsoidal hull planform is preferred, a polygonal hull planform can be used according to alternative embodiments.

In embodiments, the hull 12 can be circular, oval or elliptical forming the ellipsoidal planform.

An elliptical shape can be advantageous when the buoyant structure is moored closely adjacent to another offshore platform so as to allow gangway passage between the two structures. An elliptical hull can minimize or eliminate wave interference.

The specific design of the intermediate inwardly-tapering frustoconical side section 12*c* and the lower frustoconical side section 12*d* generates a significant amount of radiation damping resulting in almost no heave amplification for any wave period, as described below.

Intermediate inwardly-tapering frustoconical side section 12*c* can be located in the wave zone. At operational depth 71, the waterline can be located on intermediate inwardly-tapering frustoconical side section 12*c* just below the intersection with upper neck 12*b*. Intermediate inwardly-tapering frustoconical side section 12*c* can slope at an angle ($\alpha$) with respect to the vertical axis 100 from 10 degrees to 15 degrees. The inward flare before reaching the waterline significantly dampens downward heave, because a downward motion of the hull 12 increases the water plane area. In other words, the hull area normal to the vertical axis 100 that breaks the water's surface will increase with downward hull motion, and such increased area is subject to the opposing resistance of the air and or water interface. It has been found that 10 degrees to 15 degrees of flare provides a desirable amount of damping of downward heave without sacrificing too much storage volume for the vessel.

Similarly, lower frustoconical side section 12*d* dampens upward heave. The lower frustoconical side section 12*d* can be located below the wave zone (about 30 meters below the waterline). Because the entire lower frustoconical side section 12*d* can be below the water surface, a greater area (normal to the vertical axis 100) is desired to achieve upward damping. Accordingly, the first diameter $D_1$ of the lower hull section can be greater than the second diameter $D_2$ of the intermediate inwardly-tapering frustoconical side section 12*c*. The lower frustoconical side section 12*d* can slope at an angle ($\gamma$) with respect to the vertical axis 100 from 55 degrees to 65 degrees. The lower section can flare outwardly at an angle greater than or equal to 55 degrees to provide greater inertia for heave roll and pitch motions. The increased mass contributes to natural periods for heave pitch and roll above the expected wave energy. The upper bound of 65 degrees is based on avoiding abrupt changes in stability during initial ballasting on installation. That is, lower frustoconical side section 12*d* can be perpendicular to the vertical axis 100 and achieve a desired amount of upward heave damping, but such a hull profile would result in an undesirable step-change in stability during initial ballasting on installation. The connection point between upper frustoconical portion 14 and the lower frustoconical side section 12*d* can have a third diameter $D_3$ smaller than the first and second diameters $D_1$ and $D_2$.

The transit depth 70 represents the waterline of the hull 12 while it is being transited to an operational offshore position. The transit depth is known in the art to reduce the amount of energy required to transit a buoyant vessel across distances on the water by decreasing the profile of buoyant structure which contacts the water. The transit depth is roughly the intersection of lower frustoconical side section 12*d* and lower neck 12*e*. However, weather and wind conditions can provide need for a different transit depth to meet safety guidelines or to achieve a rapid deployment from one position on the water to another.

In embodiments, the center of gravity of the offshore vessel can be located below its center of buoyancy to provide inherent stability. The addition of ballast to the hull 12 is used to lower the center of gravity. Optionally, enough ballast can be added to lower the center of gravity below the center of buoyancy for whatever configuration of superstructure and pay load is to be carried by the hull 12.

The hull is characterized by a relatively high metacenter. But, because the center of gravity (CG) is low, the metacentric height is further enhanced, resulting in large righting moments. Additionally, the peripheral location of the fixed ballast further increases the righting moments.

The buoyant structure aggressively resists roll and pitch and is said to be "stiff." Stiff vessels are typically characterized by abrupt jerky accelerations as the large righting moments counter pitch and roll. However, the inertia associated with the high total mass of the buoyant structure, enhanced specifically by the fixed ballast, mitigates such accelerations. In particular, the mass of the fixed ballast increases the natural period of the buoyant structure to above the period of the most common waves, thereby limiting wave-induced acceleration in all degrees of freedom.

In an embodiment, the continuous vertical tubular handling and hoisting buoyant structure can have thrusters 99*a*-99*d*.

Figure 3:
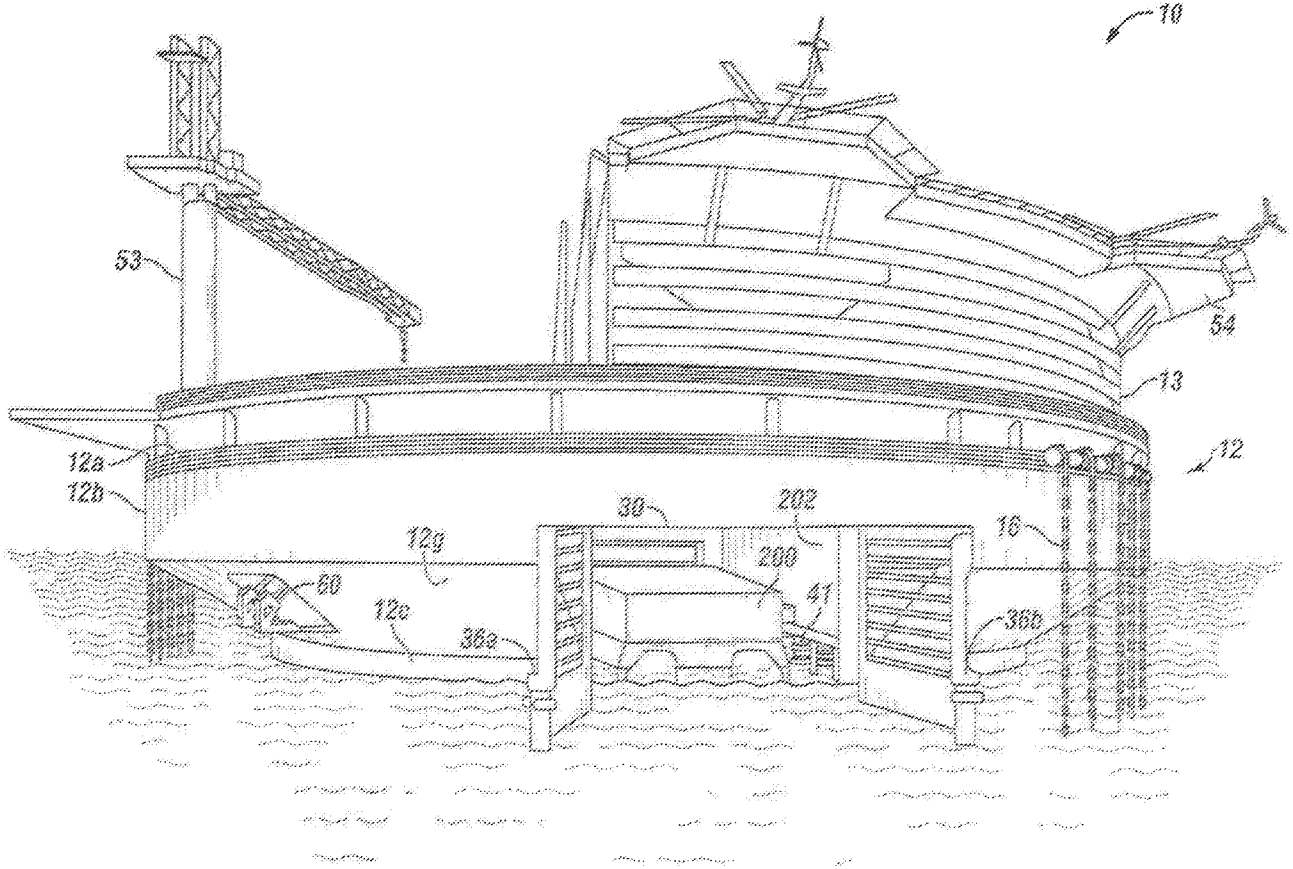
FIG. 3 is an enlarged perspective view of the floating continuous vertical tubular handling and hoisting buoyant structure at operational depth.

FIG. 3 shows the continuous vertical tubular handling and hoisting buoyant structure 10 with the main deck 12*a* and the superstructure 13 over the main deck.

In embodiments, the crane 53 can be mounted to the superstructure 13, which can include a heliport 54.

The catenary mooring lines 16 are shown coming from the upper neck 12*b*.

The inwardly-tapering upper frustoconical side section 12*g* is shown connected to the lower inwardly-tapering frustoconical side section 12*c* and the upper neck 12*b*.

The buoyant structure can have a transit depth and an operational depth, wherein the operational depth is achieved using ballast pumps and filling ballast tanks in the hull with water after moving the structure at transit depth to an operational location.

The transit depth can be from about 7 meters to about 15 meters, and the operational depth can be from about 45 meters to about 65 meters.

Figure 4:
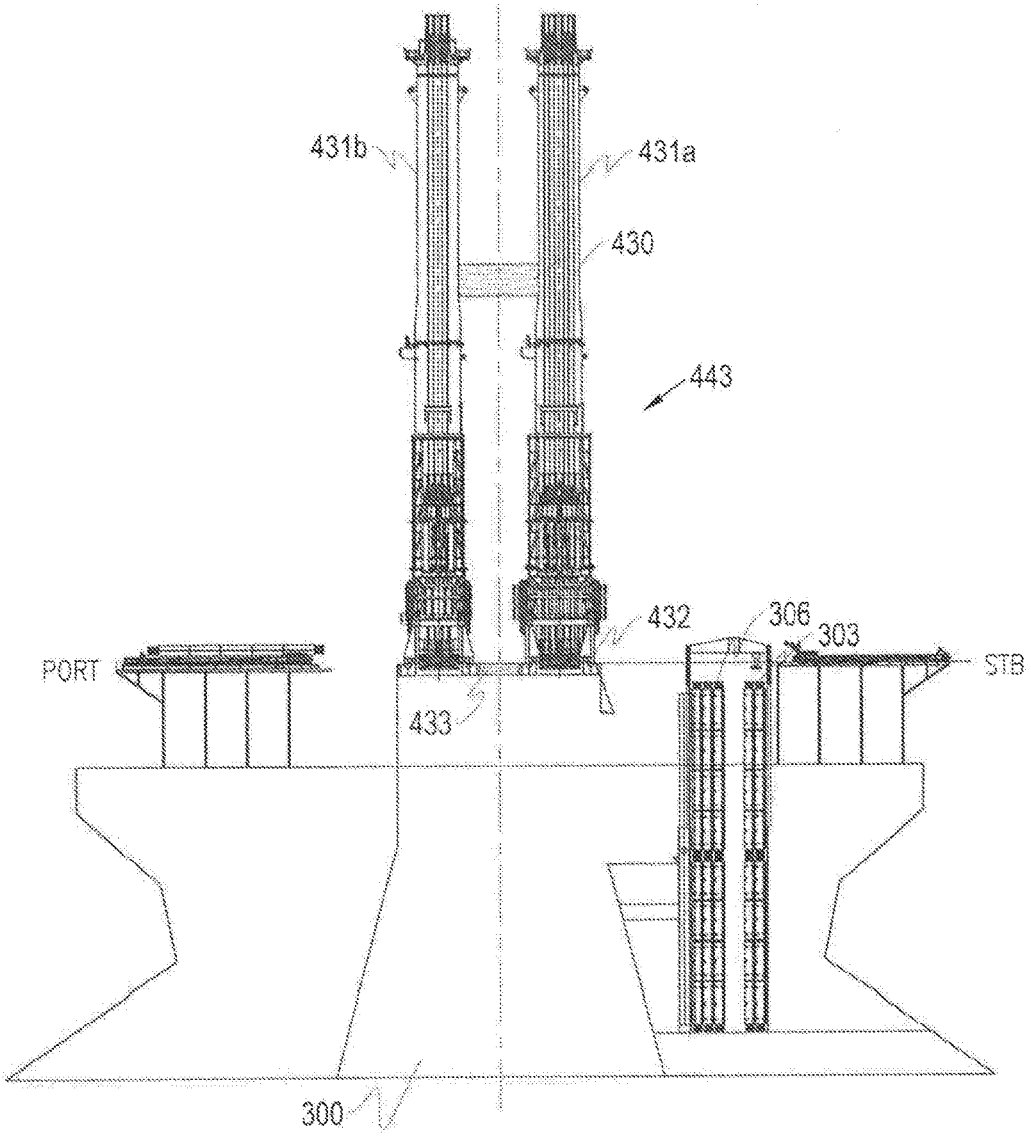
FIG. 4 is a side view of the dual spire configuration of the continuous vertical tubular handling and hoisting buoyant structure.

FIG. 4 is a side view of the dual spire configuration of the continuous vertical tubular handling and hoisting buoyant structure.

The continuous vertical tubular handling and hoisting buoyant structure has a vertically adjustable beam intersecting hoist 430 mounted to the cross bar 433 proximate the moon pool 300 and in communication with a controller. The vertically adjustable beam intersecting hoist has at least one dynamic intersecting support member 432;

The vertically adjustable beam intersecting hoist 430 can be made from a pair of parallel hoisting spires 431*a* and 431*b* connected by a cross bar 433.

The continuous vertical tubular handling and hoisting buoyant structure has a make-up break out zone 443 formed between the first and second spires and attached to the dynamic intersecting support member 432.

A marine riser stand 303 is depicted penetrating through the main deck and extending toward the ellipsoid keel in parallel with the axis 11 for containing a made-up marine riser 306.

The dynamic intersecting support member 432 can pick up the made-up marine riser 306 for subsequent lowering through the moon pool 300.

Figure 5:
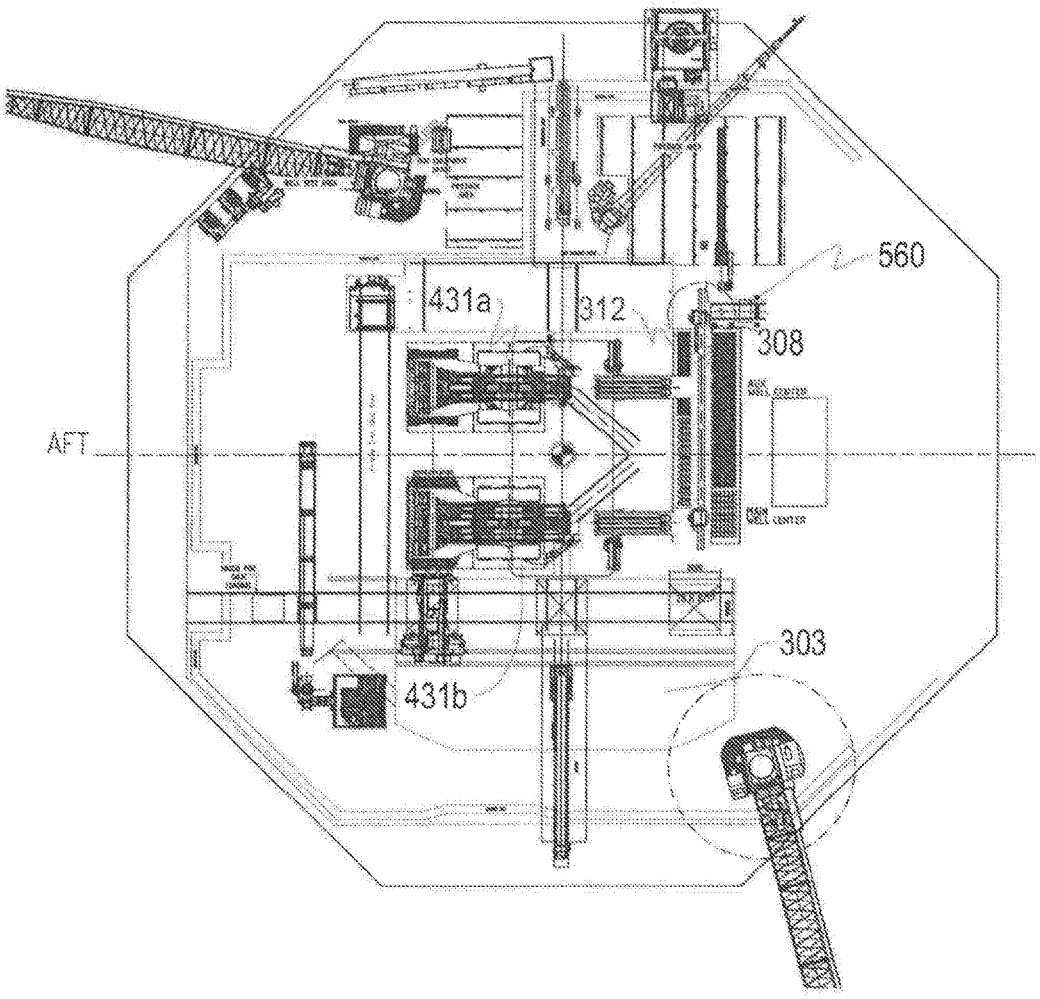
FIG. 5 is a top plan view of the continuous vertical tubular handling and hoisting buoyant structure.

FIG. 5 is a top plan view of the continuous vertical tubular handling and hoisting buoyant structure.

In embodiments, first and second spires 431*a* and 431*b* are shown.

One spire 431*a* can install made-up casing into the casing stand 308.

The other spire can install made-up marine risers 306 into the marine riser stand 303 simultaneously with the install in the casing stand 308. Both spires can install and remove jointed marine tubulars simultaneously. Both spires can remove made-up casing 312 and made-up marine risers 306, respectively, simultaneously.

A third spire acting as an automated stand building system 560.

Figure 6:
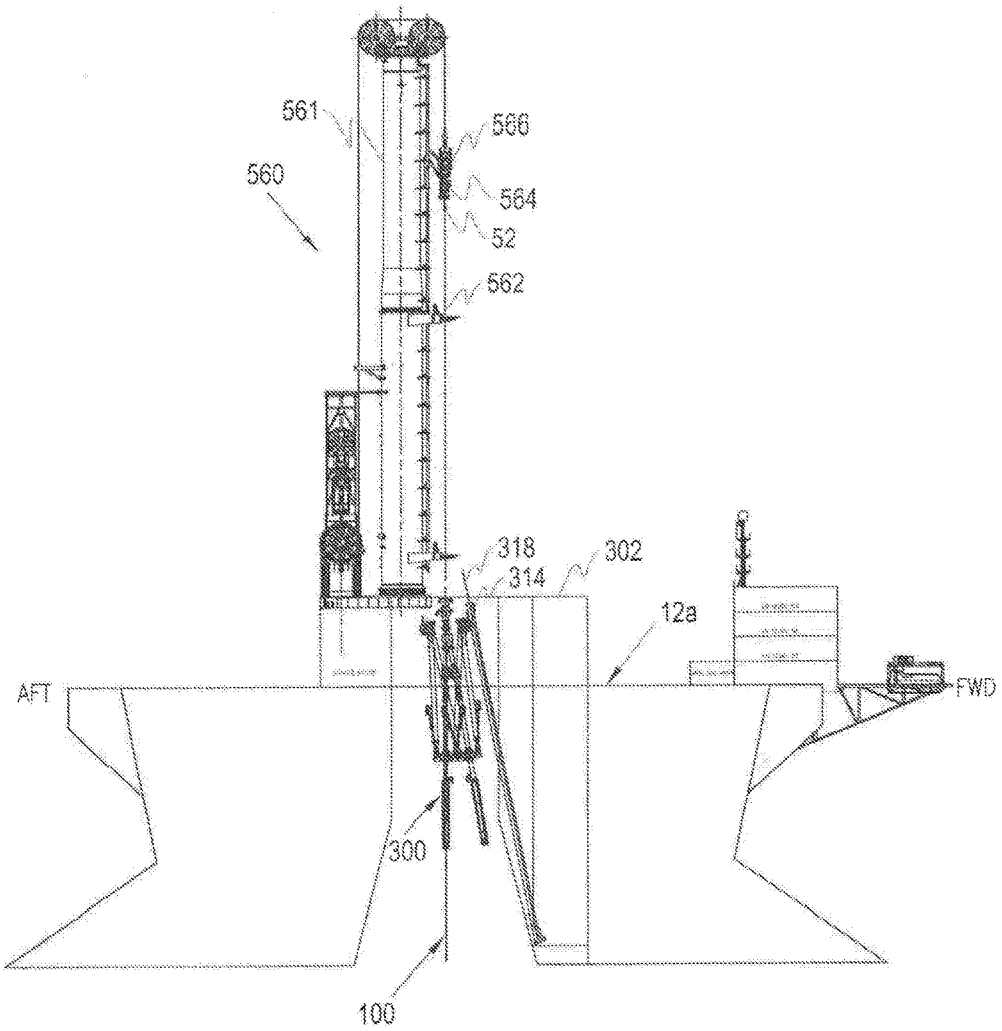
FIG. 6 is a detailed view of the third spire for use with drill pipe.

FIG. 6 is a detailed view of the third spire for use with drill pipe 318 that is known as the automated stand building system 560.

The automated stand building system has a frame 561 shown with a stand building hoist 564 having a grabber 562 for connecting with drill pipe 318 that is rotated by a torque machine 566.

The automated stand building system 560 is adjacent a moon pool 300 for installing made up drill pipe 318 into a drill pipe stand 314 that extends from an opening in the drill floor 302 towards the ellipsoid keel.

The stand building hoist 564 can be used to make-up or disassemble marine risers, casing 312, and drill pipe 318 by: raising non-made-up marine risers 306, non-made up casing 312, and non-made up drill pipe 318: lowering non-made-up marine risers, non-made-up casing 312, and non-made-up drill pipe 318; raising made-up marine risers 306, made-up easing 312, and made-up drill pipe 318; lowering made-up marine risers 306, made-up drill pipe 318, and made-up casing 312.

In embodiments, the axis 100 of the continuous vertical tubular handling and hoisting buoyant structure 10 is shown.

A hook 52 connects to the vertically adjustable beam intersecting hoist 430 to deploy marine objects through the moon pool to a sea bed.

Figure 7:
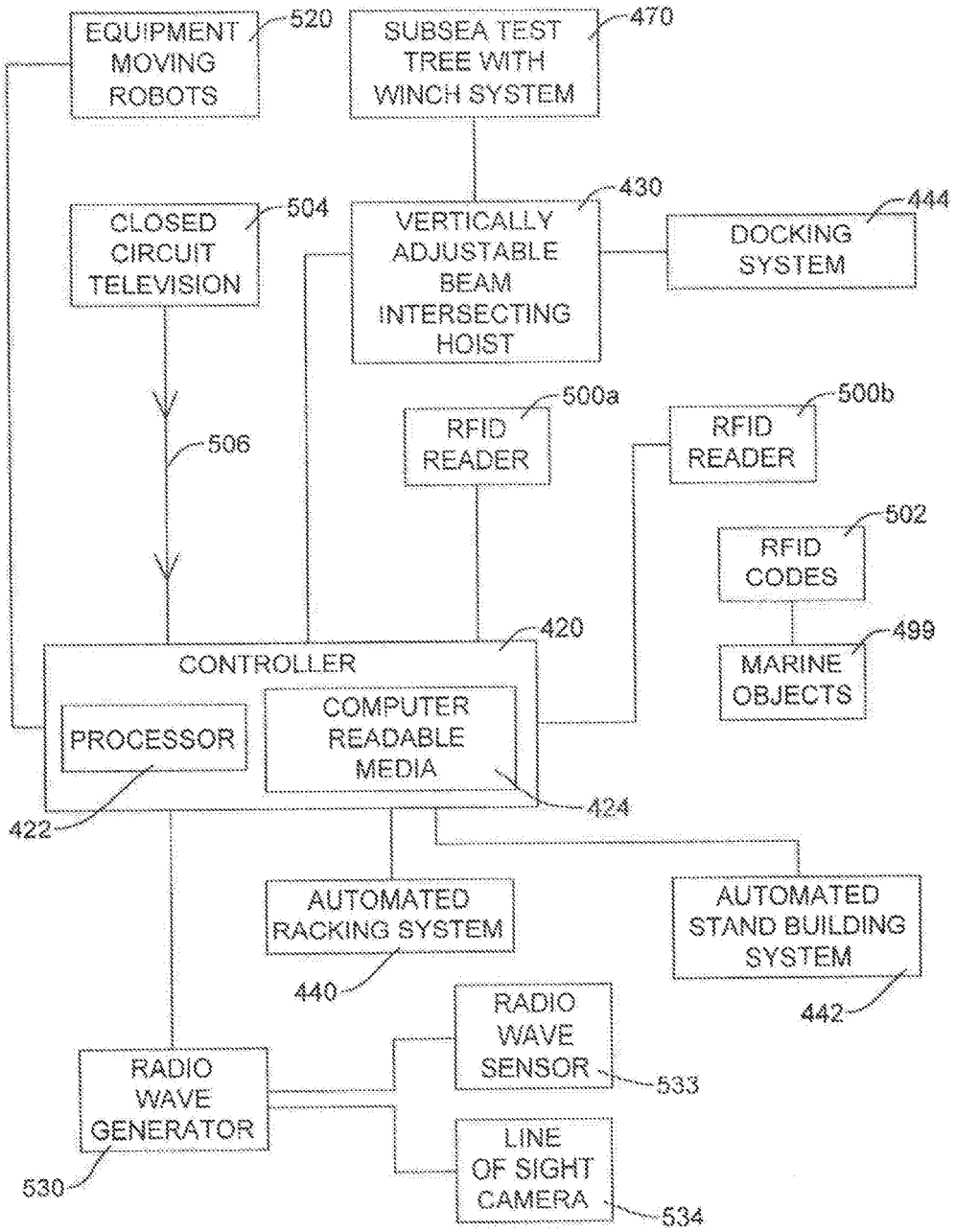
FIG. 7 is a diagram of the components of the buoyant structure connected to a controller.

FIG. 7 is a diagram of the components of the continuous vertical tubular handling and hoisting buoyant structure 10 connected to a controller 420.

A controller 420 with a processor 422 and computer readable media 424 is depicted.

The automated racking system 440 is mounted to the hull 12 in communication with the controller 420. The automated racking system 440 is configured to install and remove made-up marine risers 306 in the marine riser stand 303 and made-up casing 312 in the casing stand 308.

The automated stand building system 442 mounted to the hull 12 is in communication with the controller 420 and mounted adjacent the automated racking system 440.

The automated stand building system 442 is configured to make up marine risers 306, make up casing 312 and make up drill pipe 318 from an angle from 55 to 125 degrees from the horizontal plane of the ellipsoid keel.

The vertically adjustable beam intersecting hoist 430 mounted to the crossbeam proximate the moon pool is in communication with the controller 420.

A subsea test tree with winch system 470 is affixed to the vertically adjustable beam intersecting hoist 430 and in communication with the controller 420.

A docking system 444 secured to one of the spires is in communication with the controller.

A plurality of RFID readers 500*a* and 500*b* are mounted in the hull and in communication with the controller 420.

The plurality of RIFD readers are configured to scan RFID codes 502 attached to incoming and outgoing marine objects 499.

Each RFID code 502 indicates a priority zone 428 in the hull 12.

The RFID readers 500*a,b* are installed adjacent at least one of: the moon pool 300, the automated racking system 440, the drill floor 302, the main deck 12*a,* and areas between the main deck 12*a* and the ellipsoid keel 12*f* in the hull 12.

In embodiments, a closed circuit television 504 is mounted in the hull in communication with the controller 420. The closed circuit television 504 provides a closed circuit television feed 506 to the computer readable media of the controller.

In embodiments, the continuous vertical tubular handling and hoisting buoyant structure 10 has a radio wave generator 530 connected to the controller 420.

The radio wave generator 530 is in communication with radio wave sensor 533 and a line of sight camera 534.

Also, equipment moving robots 520 are in communication with the controller 420.

Figure 8:
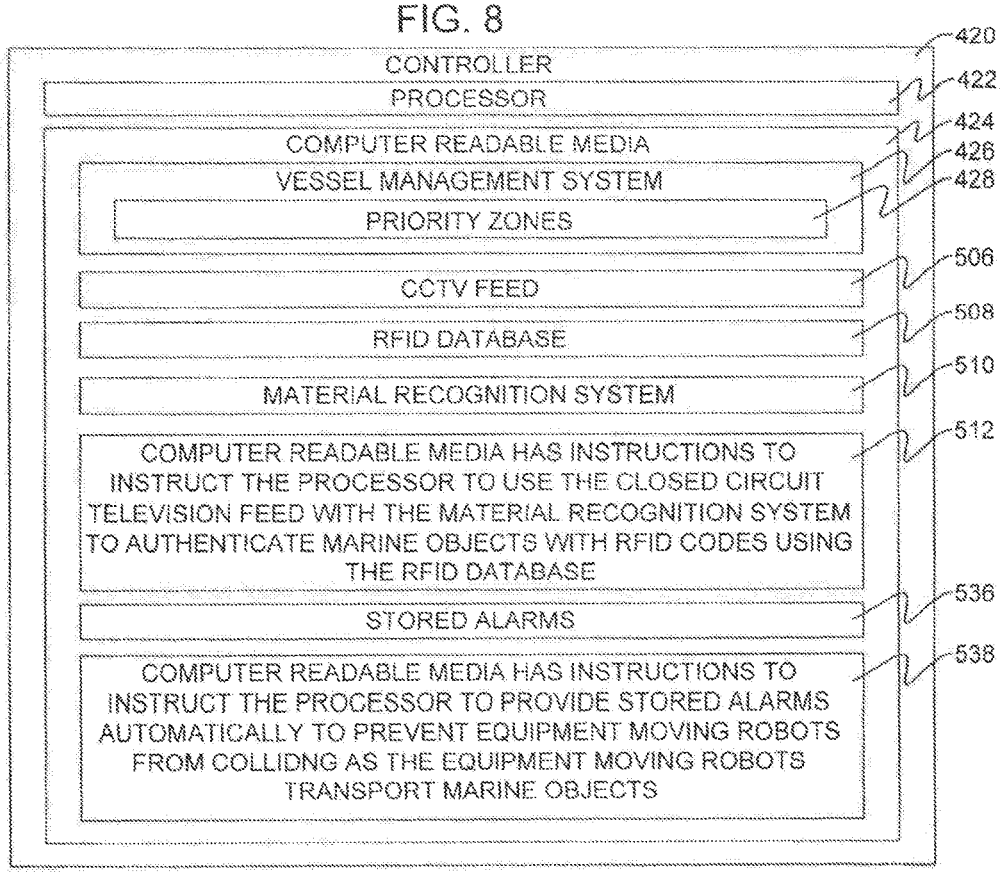
FIG. 8 is a diagram of the controller according to an embodiment.

FIG. 8 is a diagram of the controller 420 according to an embodiment.

The controller 420 has a processor 422, such as a computer, which additionally communicates with a computer readable media 424 that includes: a vessel management system 426 with priority zones 428 for marine objects within the hull 12.

The computer readable media 424 stores the CCTV feed 506, and the RFID database 508.

The RFID database 508 links RFID codes to one of the marine objects 499 in the hull 12.

In embodiments, the computer readable media 424 stores a material recognition system 510.

The computer readable media has instructions 512 to instruct the processor 422 to use the closed circuit television feed 506 with the material recognition system 510 to authenticate marine objects 499 with RFID codes 502 using the RFID database 508.

The computer readable media has stored alarms 536.

The computer readable media has instructions 538 to instruct the processor 422 to provide stored alarms 536 automatically to prevent equipment moving robots 520 from colliding as the equipment moving robots 520 transport marine objects 499.

Figure 9:
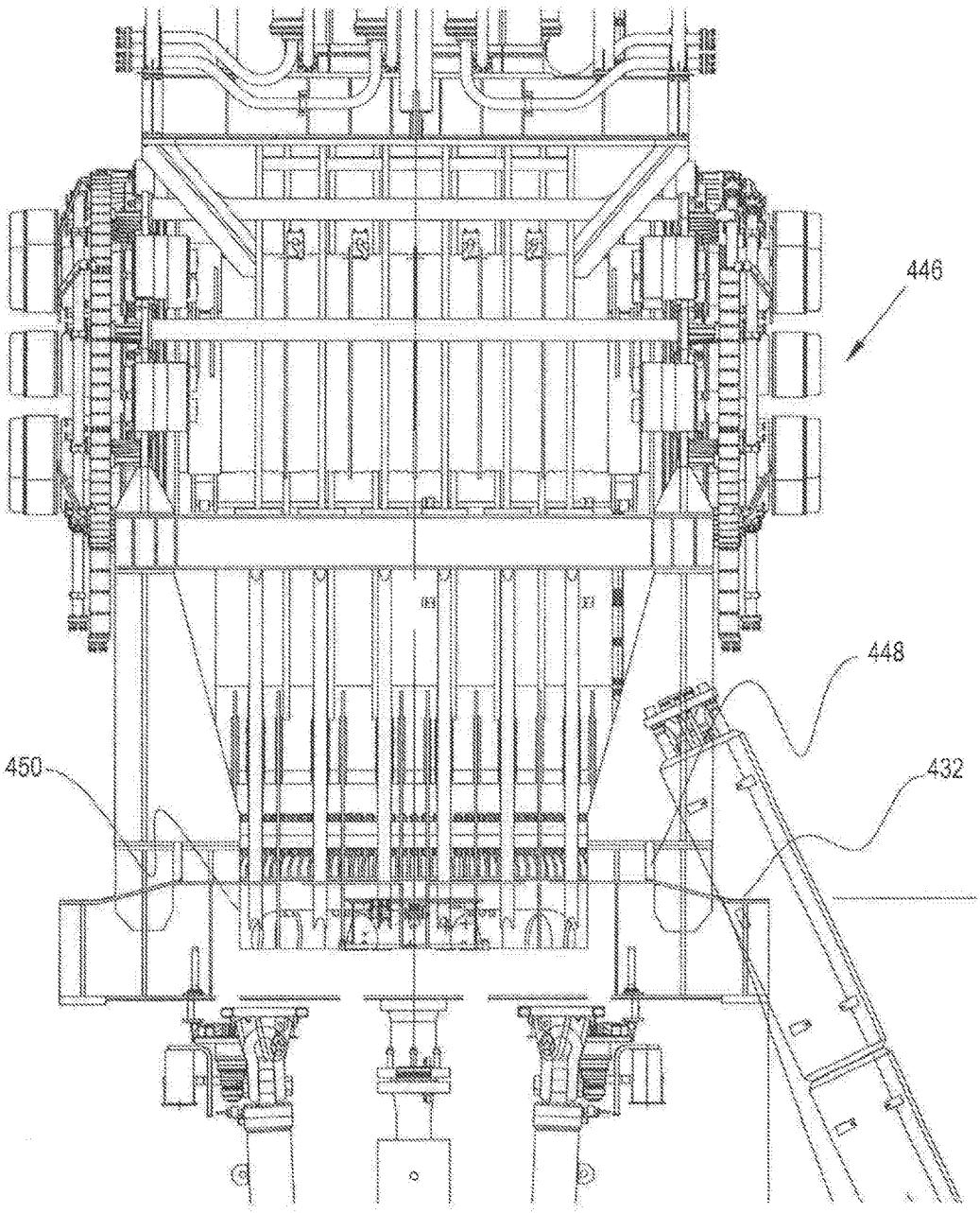
FIG. 9 is a detail of the dynamic intersecting support beam with subsea deployment system.

FIG. 9 is a detail of the dynamic intersecting support beam 432 with subsea deployment system 446.

The subsea deployment system 446 has a plurality of sheaves 448 mounted to the dynamic intersecting support member 432 and an automatically adjustable heave compensator with hoisting system 450 mounted to the plurality of sheaves 448.

Figure 10:
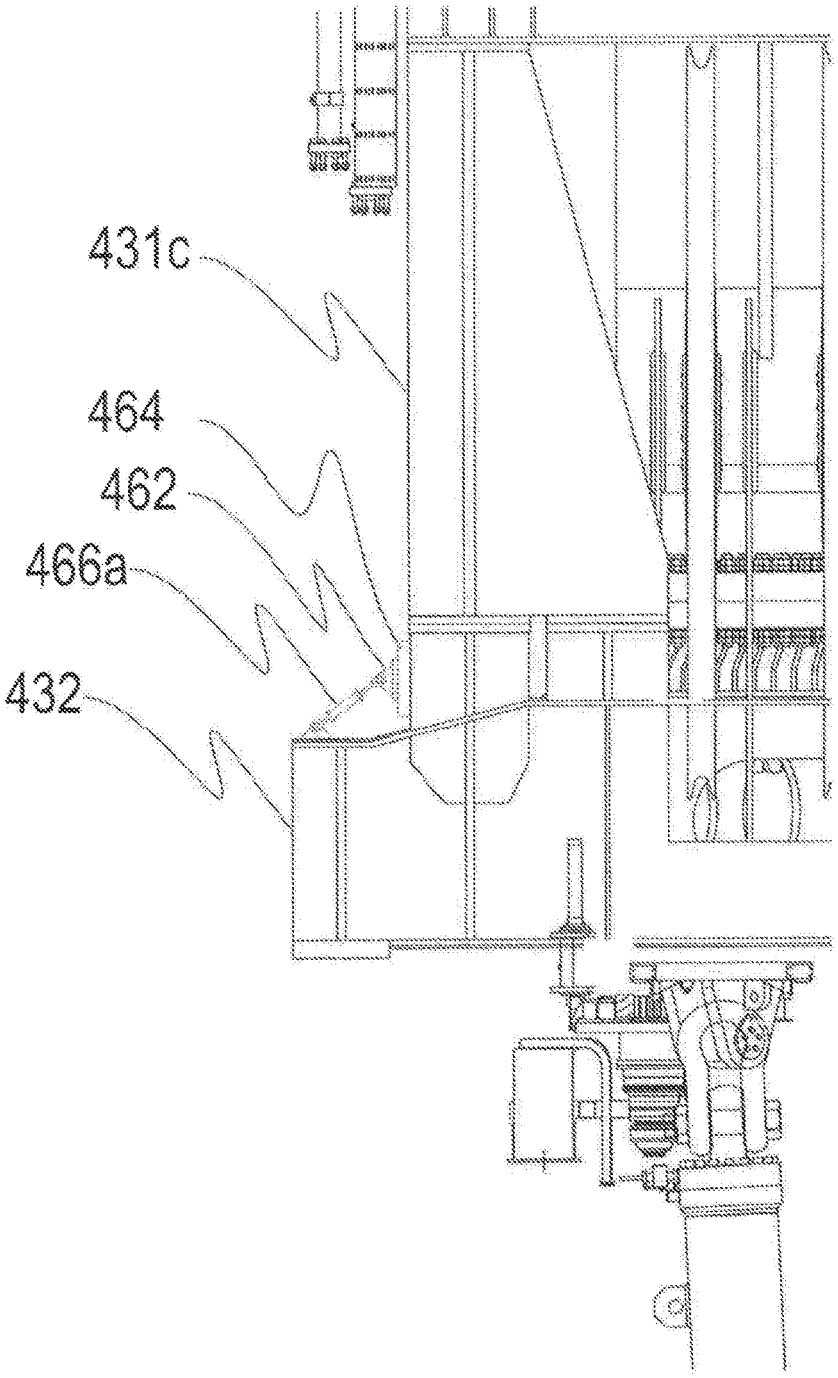
FIG. 10 is a detail of the automated racking system

FIG. 10 is a detail of the automated racking system 440.

A spire 431*c* with a latching mechanism 462 for engaging the spire 431*c* is used.

A rack and pinion 464 is mounted on at least one spire 431*c* operating the dynamic intersecting support member 432 to adjust height of made-up marine tubulars and height of bottom hole assemblies.

A plurality of hydraulic pistons 466*a* is used.

Each hydraulic piston 466*a* is attached on one end to the spire 431*c* and on the other end to the dynamic intersecting support member 432.

The plurality of hydraulic pistons 466*a* are configured to angulate the dynamic intersecting support member 432 to and from a horizontal plane parallel to the horizontal plane of the ellipsoid keel.

Figure 11:
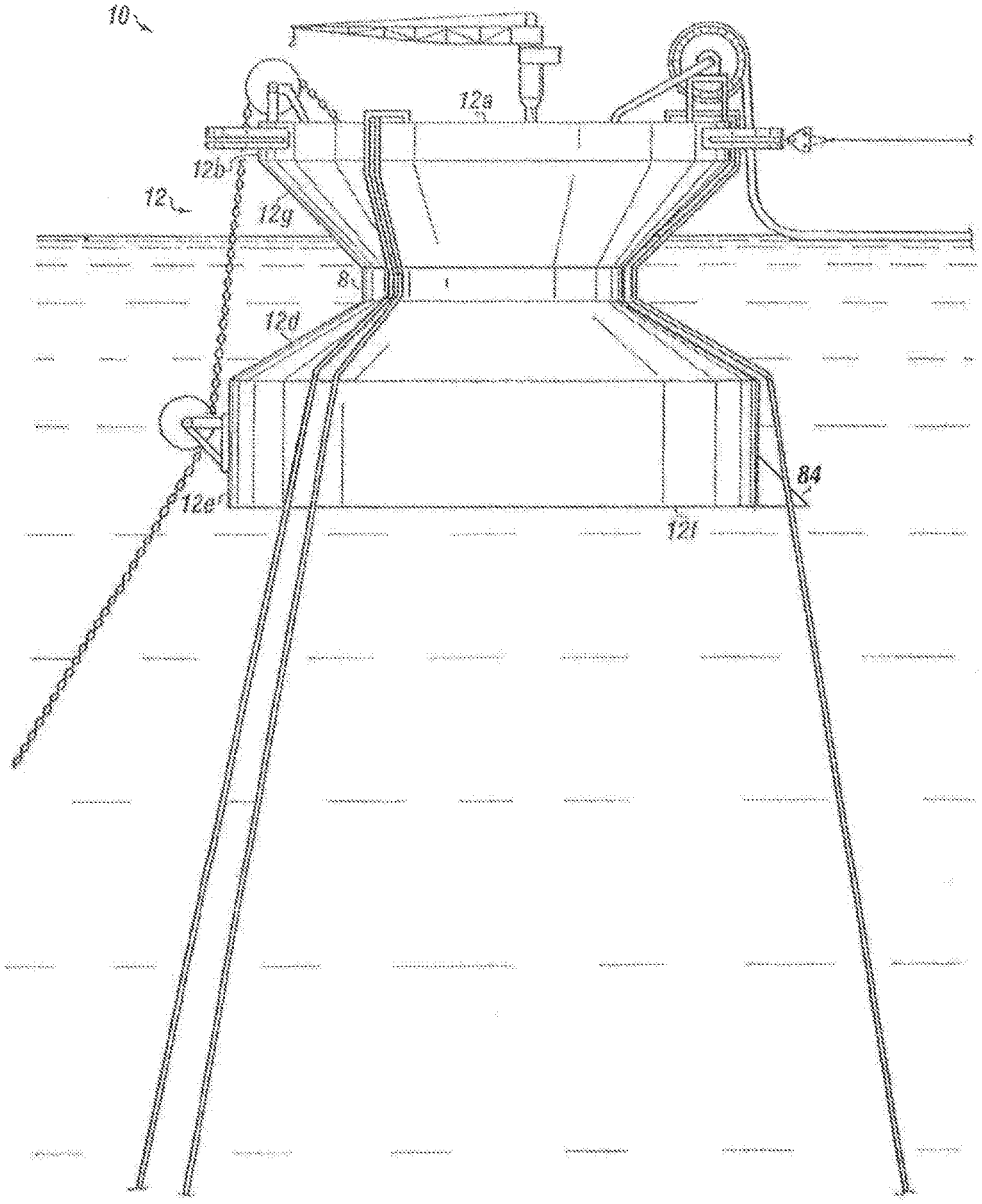
FIG. 11 is a side view of the continuous vertical tubular handling and hoisting buoyant structure with an intermediate neck, which can be cylindrical.

FIG. 11 is a side view of the continuous vertical tubular handling and hoisting buoyant structure 10 with an intermediate neck 8.

The continuous vertical tubular handling and hoisting buoyant structure 10 is shown having a hull 12 with a main deck 12*a*.

The continuous vertical tubular handling and hoisting buoyant structure 10 has an upper neck 12*b* extending downwardly from the main deck 12*a* and an upper frustoconical side section 12*g* extending from the upper neck 12*b*.

The continuous vertical tubular handling and hoisting buoyant structure 10 has an intermediate neck 8 connecting to the upper frustoconical side section 12*g*.

A lower frustoconical side section 12*d* extends from the intermediate neck 8.

A lower neck 12*e* connects to the lower frustoconical side section 12*d*.

An ellipsoid keel 12*f* is formed at the bottom of the lower neck 12*e*.

A fin-shaped appendage 84 is secured to a lower and an outer portion of the exterior of the ellipsoid keel 12*f*.

FIG. 12 is detailed view of the continuous vertical tubular handling and hoisting buoyant structure 10 with an intermediate neck 8.

The continuous vertical tubular handling and hoisting buoyant structure 10 is shown with the intermediate neck 8.

A fin-shaped appendage 84 is shown secured to a lower and an outer portion of the exterior of the ellipsoid keel 12*f* and extends from the ellipsoid keel 12*f* into the water.

FIG. 13 is a cut away view of the continuous vertical tubular handling and hoisting buoyant structure 10 with an intermediate neck 8 in a transport configuration.

The buoyant structure 10 is shown with the intermediate neck 8.

In embodiments, the buoyant structure 10 can have a pendulum 116, which can be moveable. In embodiments, the pendulum is optional and can be partly incorporated into the hull 12 to provide optional adjustments to the overall hull performance.

In this Figure, the pendulum 116 is shown at a transport depth.

In embodiments, the moveable pendulum can be configured to move between a transport depth and an operational depth and the pendulum can be configured to dampen movement of the watercraft as the watercraft moves from side to side in the water.

FIG. 14 is a cut away view of the continuous vertical tubular handling and hoisting buoyant structure 10 with an intermediate neck 8 in an operational configuration.

In this Figure, the pendulum 116 is shown at an operational depth extending from the buoyant structure 10.

In embodiments, the continuous vertical tubular handling and hoisting buoyant structure has a subsea test tree with winch system 470 affixed to the vertically adjustable beam intersecting hoist 430.

In embodiments, the vertically adjustable beam intersecting hoist 430 has a pair of parallel hoisting spires 431*a* and 431*b* connected by a cross bar 433.

In embodiments, the main deck 12*a* has a superstructure 13 has at least one member selected from the group consisting of: crew accommodations 58, a heliport 54, a crane 53, a control tower 51, a dynamic position system 99*a*-99*d* in the control tower 51, and an aircraft hangar 50.

In embodiments, the moon pool 300 has a shape in the horizontal plane of the hull 12 selected from the group: ellipsoid, rectangular, octagonal and multi-angular.

In embodiments, the moon pool 300 has a frustoconical shape extending parallel to the axis.

In embodiments, the vertically adjustable beam intersecting hoist 430 has an H shape.

In embodiments, the dynamic intersecting support member 432 has: a make-up break out zone 443 formed between the first and second spires and attached to the dynamic intersecting support member 432.

In embodiments, the continuous vertical tubular handling and hoisting buoyant structure 10 has a docking system 444 secured to one of the spires 431*a* and 431*b*.

In embodiments, the continuous vertical tubular handling and hoisting buoyant structure 10 has a subsea deployment system 446.

The subsea deployment system has a plurality of sheaves 448 mounted to the dynamic intersecting support member 432; an automatically adjustable heave compensator with hoisting system 450 mounted to the plurality of sheaves 448; and a hook 52 connected to the vertically adjustable beam intersecting hoist 430 to deploy marine objects 499 through the moon pool 300 to a sea bed.

In embodiments, the automated racking system 440 has a latching mechanism for engaging a spire; a rack and pinion 464 mounted on at least one spire 431*a* and 431*b* operating the dynamic intersecting support member 432 to adjust height of made-up marine tubulars 117 and height of bottom hole assemblies; and a plurality of hydraulic pistons 466*a*.

Each hydraulic piston 466*a* is attached on one end to a spire 431*a* and 431*b* and on the other end to the dynamic intersecting support member 432, the plurality of hydraulic pistons 466*a* configured to angulate the dynamic intersecting support member 432 to and from a horizontal plane parallel to the horizontal plane of the ellipsoid keel 12*f*.

In embodiments, the continuous vertical tubular handling and hoisting buoyant structure 10 includes: a plurality of RFID readers 500*a* and 500*b* mounted in the hull 12 in communication with the controller 420, the plurality of RIFD readers 500*a* and 500*b* are configured to scan RFID codes 502 attached to incoming and outgoing marine objects 499, each RFID code 502 indicating a priority zone 428 in the hull 12 of the vessel management system 426, the RFID readers 500*a,b* installed adjacent at least one of: the moon pool 300, the automated racking system, the drill floor 302, the main deck 12*a,* and areas between the main deck 12*a* and the ellipsoid keel 12*f* in the hull 12; a closed circuit television 504 mounted in the hull 12 in communication with the controller 420 providing a closed circuit television feed 506 to the computer readable media 424; an RFID database 508 in the computer readable media 424, the RFID database 508 linking RFID codes 502 to one of the marine objects 499 in the hull 12; a material recognition system 510 in the computer readable media 424; instructions in the computer readable media 424 to instruct the processor 422 to use the closed circuit television feed 506 with the material recognition system 510 to authenticate marine objects 499 with RFID codes 502 using the RFID database 508; and a plurality of equipment moving robots 520 in communication with the controller 420 to move a RFID scanned and visually authenticated marine object 499 to a priority zone 428.

In embodiments, the continuous vertical tubular handling and hoisting buoyant structure 10 has at least one of: a radio wave generator 530 with radio wave sensors 533 and a line of sight camera 534 in communication with the controller 420, the computer readable media 424 having stored alarms 536 and instructions 538 to instruct the processor to provide stored alarms automatically to prevent equipment moving robots from colliding as the equipment moving robots transport marine objects.

In embodiments, the continuous vertical tubular handling and hoisting buoyant structure 10 has an upper neck 12*b* that extends downwardly from the main deck 12*a;* an upper frustoconical side section 12*g* located below upper neck 12*b* and maintained above a water line for a transport depth and partially below a water line for an operational depth; and wherein the upper frustoconical side section 12*g* has a gradually reducing diameter from a diameter of the upper neck 12*b*.

In embodiments, the automated stand building system 442 has a load supporting frame 561 extending above the main deck 12*a;* a stand building hoist 564 to raise non-made-up marine risers 306, raise non-made up casing 312, non-made up drill pipe 318, and lower made-up marine risers 306, made-up casing 312 and made-up drill pipe 318 and raise made-up marine risers 306, made-up casing 312, and made-up drill pipe 318 for break out into non-made-up marine risers 306, non-made-up drill pipe 318 and non-made-up casing 312; a grabber 562 attached to the stand building hoist 564; and a torque machine 566 attached to the load supporting frame 561 to tension or de-tension made-up marine risers 306, made-up casing 312 or made-up drill pipe 318.

In embodiments, the vertically adjustable beam intersecting hoist 430 can have a "+" shape, an "I" shape, or a "#" shape.

As an example, in this invention, a closed circuit television feed 506 scanning a pipe or a valve connects to a processor 422 with computer readable media 424 having the material recognition system 510 to perform a material recognition. An RFID reader 500*a* and 500*b* is also connected to the processor 422 to read the RFID code 502 on the pipe or valve. The processor 422 then uses instructions in the computer readable media 424 to compare the read RFID code 502 to a list of RFID codes in the RFID database 508 to verify the RFID code 502 belongs to that recognized object and also belongs on board the buoyant structure. In this way, the processor authenticates the scanned marine objects 499 using the material recognition simultaneously with that RFID codes 502 verifying that the marine object 499 is supposed to be onboard the structure, and verifying which priority zone 428 the object is supposed to be on the buoyant vessel.

More specifically, the closed circuit TV 504 and an RFID reader 500*a* and 500*b* both scan a valve. The processor 422 compares the RFID code 502 stored for the buoyant structure and the identification through scanning, and provides a notice to an operator connected to the processor 422 that the scanned valve is not only the correct valve, but supposed to be on board the buoyant structure.

An exemplary buoyant structure—Driller SSP—The Ultimate Drilling Machine (UDM)

A continuous vertical tubular handling and hoisting buoyant structure 10 that has a height of 75 meters and a diameter of 100 meter has a vertical axis 100 through the moon pool 300 can be used for making up, breaking out and installing marine objects 499.

The continuous vertical tubular handling and hoisting buoyant structure termed "Driller SSP—The Ultimate Drilling Machine (UDM)" can have a hull 12 with several vertical components.

The hull of "Driller SSP—The Ultimate Drilling Machine (UDM)" has a main deck 12*a* with multiple levels. A drill floor 302 is built 15 meters above the main deck 12*a*.

The hull has an upper neck 12*b* extending 5 meters from and connected to the main deck 12*a*.

The "Driller SSP—The Ultimate Drilling Machine (UDM)" has an upper frustoconical side section 12*g* extending 40 meters away from the upper neck and connected to the upper neck.

The hull 12 of the "Driller SSP—The Ultimate Drilling Machine (UDM)" has an intermediate neck 8 connected to the upper frustoconical side section 12*g* extending 5 meters from the upper frustoconical side section 12*g*.

A lower frustoconical side section 12*d,* 20 meters long that extends from and connects to the intermediate neck 8.

A lower neck 12*e* 5 meters long extends from the lower frustoconical side section 12*d*.

A polygonal keel 12*f* that is reinforced having a horizontal plane is mounted to the lower neck 12*e*.

A fin-shaped appendage 84 that is triangular in cross section is secured to an outer portion of the ellipsoid keel 12*f* and extends away from the keel 7 meters.

A moon pool 300 having a multicrosssectional area that changes in diameter and shape is formed in the hull 12.

A marine riser stand 303 can extend 150 feet into the hull 12, aligned with the axis of the hull 100.

The marine riser stand 303 has an opening in the main deck 12*a* and is used to contain at least 14,000 feet of marine riser 306 that is 100 made-up marine risers 306.

A casing stand 308 is formed that in this example has a different length, (but in other examples can have an identical length to the marine riser stand 303). For the casing 312, this casing stand 308 could be 180 feet in length, and like the marine riser stand 303 penetrate from an opening through the main deck 12*a* and extend toward the ellipsoid keel 12*f* in parallel with the axis for containing a made-up casing 312. In this Driller SSP, 20,000 feet of casing 312 could be contained in the casing stand 308 that, is 140 made-up casing joints.

A drill pipe stand 314 is formed in this example identical to the easing stand 308, penetrating through the main deck 12*a* and extending toward the ellipsoid keel 12*f* in parallel with the axis for containing made-up drill pipe 318.

In this example, Driller SSP—The Ultimate Drilling Machine (UDM), each stand is oriented at an angle of 90 degrees to the horizontal plane of the ellipsoid keel 12*f*.

In this example, the Driller SSP—The Ultimate Drilling Machine (UDM) has a controller 420 with a processor 422 such as a computer, and computer readable media 424. The computer readable media 424 comprising: a vessel management system 426 with priority zones 428 for marine objects 499 within the hull 12.

The Driller SSP—The Ultimate Drilling Machine (UDM) has a vertically adjustable beam intersecting hoist 430 mounted to the crossbar 433 proximate the moon pool 300 and in communication with the controller 420. The hoist has at least one dynamic intersecting support member 432 and is capable of lifting 2000 short tons.

An automated racking system 440 capable of handling 36 drill pipe stands 314 per hour is mounted to the hull.

The automated racking system 440 is in communication with the controller 420 and can automatically grab individual drill pipe 318, lift the pipe, connect to a second pipe, turn the drill pipe 318 threading the pipe together, and then lower the made up drill pipe 318. The automated racking system 440 configured to install and remove made-up marine risers 306 in the marine riser stand 303 made-up casing 312 in the casing stand 308.

Connected to the controller 420 is an automated stand building system 560 to make multiple marine risers 306. The automated stand building system 560 can make up 15 joints per hour and is mounted adjacent the automated racking system 440.

The Driller SSP—The Ultimate Drilling Machine (UDM) has an automated stand building system 560 configured to make up marine risers 306, make up casing 312 and make up drill pipe 318 from an angle from 95 degrees from the horizontal plane of the ellipsoid keel 12*f*.

While these embodiments have been described with emphasis on the embodiments, it should be understood that within the scope of the appended claims, the embodiments might be practiced other than as specifically described herein.

What is claimed is:

1. A continuous vertical tubular handling and hoisting buoyant structure with an axis for making up, breaking out and installing marine objects, the continuous vertical tubular handling and hoisting buoyant structure comprising:

a. a hull comprising:
   (i) a main deck;
   (ii) upper neck connected to the main deck;
   (iii) an upper frustoconical side section connected to the upper neck;
   (iv) an intermediate neck connected to the upper frustoconical side section;
   (v) lower frustoconical side section that extends from the intermediate neck;
   (vi) a lower neck extending from the lower frustoconical side section;
   (vii) an ellipsoid keel having a horizontal plane mourned to the lower neck;
   (viii) a fin-shaped appendage secured to an outer portion of the ellipsoid keel, and a moon pool formed in the hull;
   (ix) a drill floor mounted above the main deck and the ellipsoid keel and around the moon pool;
   (x) a marine riser stand penetrating through the main deck and extending toward the ellipsoid keel in parallel with the axis for containing a made-up marine riser;
   (xi) a easing stand penetrating through the mam deck and extending toward the ellipsoid keel in parallel with the axis for containing a made-up casing;
   (xii) a drill pipe stand penetrating through the main deck and extending toward the ellipsoid keel in parallel with the axis for containing made-up drill pipe;
   (xiii) a spire mounted to the hull with a cross bar; and wherein each stand is oriented at an angle from 60 degrees to 120 degrees to the horizontal plane of the ellipsoid keel; and wherein each made-up marine riser, made-up casing, or made-up drill pipe has a length from 50 feet to 270 feet;

b. a controller with a processor and computer readable media, the computer readable media comprising a vessel management system with priority zones for marine objects within the hull;

c. a vertically adjustable beam intersecting hoist mounted to the crossbar proximate the moon pool and in communication with the controller comprising at least one dynamic intersecting support member;

d. an automated racking system mounted to the hull in communication with the controller, the automated racking system configured to install and remove the made-up marine risers in the marine riser stand and the made-up casing in the casing stand; and e. an automated stand building system mounted to the hull in communication with the controller and adjacent the automated racking system, the automated stand building system configured to make up the marine risers, make up casing, and make up drill pipe from an angle from 55 to 125 degrees from the horizontal plane of the ellipsoid keel.

2. The continuous vertical tubular handling and hoisting buoyant structure of claim 1, comprising a subsea test tree with winch system affixed to the vertically adjustable beam intersecting hoist md in communication with the controller.

3. The continuous vertical tubular handling and hoisting buoyant structure of claim 1, wherein the vertically adjustable beam intersecting hoist comprises a first and second additional parallel hoisting spires with the vertically adjustable beam intersecting hoist connecting between the pair of spires.

4. The continuous vertical tabular handling and hoisting buoyant structure of claim 1, wherein the main deck has a superstructure comprising at least one member selected from the group consisting of: crew accommodations, a heliport, a crane, a control tower, a dynamic position system in the control tower, and an aircraft hangar.

5. The continuous vertical tubular handling and hoisting buoyant structure of claim 1, wherein the moon pool comprises a shape in the horizontal plane of the hull selected from the group: ellipsoid, rectangular, octagonal and multiangular.

6. The continuous vertical tubular handling and hoisting buoyant structure of claim 1, wherein the moon pool comprises a frustoconical shape extending parallel to the axis.

7. The continuous vertical tubular handling and hoisting buoyant structure of claim 3, wherein the vertically adjustable beam intersecting hoist comprises an "H" shape.

8. The continuous vertical tubular handling and hoisting buoyant structure of claim 3, wherein the dynamic intersecting support member comprises: a make-up break out zone formed between the first and second spires and attached to the dynamic intersecting support member.

9. The continuous vertical tubular handling and hoisting buoyant structure of claim 8, comprising a docking system secured to at least one spire and in communication with the controller.

10. The continuous vertical tubular handling and hoisting buoyant structure of claim 1, comprising a subsea deployment system, wherein the subsea deployment system comprises:

a. a plurality of sheaves mourned to the dynamic intersecting support member; and b. an automatically adjustable heave compensator with hoisting system mounted to the plurality of sheaves; and c. a hook connected to the vertically adjustable beam intersecting hoist to deploy marine objects through the moon pool to a sea bed.

11. The continuous vertical tubular handling and hoisting buoyant structure of claim 1, wherein the automated racking system comprises:

a. a latching mechanism for engaging a spire;

b. a rack and pinion mounted on the at least one spire operating the dynamic intersecting support member to adjust height of made-up marine tubulars and height of bottom hole assemblies; and c. a plurality of hydraulic pistons, each hydraulic piston attached on one end to the at least one spire and on the other end to the dynamic intersecting support member, the plurality of hydraulic pistons configured to angulate the dynamic intersecting support member to and from a horizontal plane parallel to the horizontal plane of the ellipsoid keel.

12. The continuous vertical tubular handling and hoisting buoyant structure of claim 1, comprises:

a. a plurality of RFID readers mounted in the hull in communication with the controller, the plurality of RFID readers are configured to scan RFID codes attached to incoming and outgoing marine objects, each RFID code indicating a priority zone in the hull, the RFID readers installed adjacent at least one of: the moon pool, the automated racking system, the drill floor, the main deck, and areas between the main deck and the ellipsoid keel in the hull;

b. a closed circuit television mounted in the hull in communication with the controller providing a closed circuit television feed to the computer readable media;

c. an RFID database in the computer readable media, the RFID database linking RFID codes to one of the marine objects in the hull;

d. a material recognition system in the computer readable media;

e. instructions in the computer readable media to instruct the processor to use the closed circuit television feed with the material recognition system to authenticate marine objects with RFID codes using the RFID database; and f. a plurality of equipment moving robots in communication with the controller to move a RFID scanned and visually authenticated marine object to a priority zone.

13. The continuous vertical tubular handling and hoisting buoyant structure of claim 12, further comprising at least one of: a radio wave generator with a radio wave sensor and a line of sight camera in communication with the controller, the computer readable media having stored alarms and instructions to instruct the processor to provide stored alarms automatically to prevent equipment moving robots from colliding as the equipment moving robots transport marine objects.

14. The continuous vertical tubular handling and hoisting buoyant structure of claim 1, wherein:

(i) the upper neck extends downwardly from the main deck;

(ii) the upper frustoconical side section is located above the intermediate neck and maintained above a water line for a transport depth and partially below a water line for an operational depth; and wherein the upper frustoconical side section has a gradually reducing diameter from a diameter of the upper neck.

15. The continuous vertical tubular handling and hoisting buoyant structure of claim 1, wherein the automated stand building system comprises:

a. a load supporting frame extending above the main deck;

b. a stand building hoist to make-up or disassemble marine risers, casing and drill pipe by:

(i) raising non-made-up marine risers, non-made up easing, and non-made up drill pipe, (ii) lowering non-made-up marine risers, non-made-up easing, and non-made-up drill pipe;

(iii) raising made-up marine risers, made-up casing, and made-up drill pipe;

(iv) lowering made-up marine risers, made-up drill pipe, and made-up casing;

c. a grabber attached to the load supporting frame; and d. a torque machine attached to the load supporting frame to tension or de-tension made-up or non-made up; marine risers, easing or drill pipe.

* * * * *